US009587195B2

(12) United States Patent
Brewer

(10) Patent No.: US 9,587,195 B2
(45) **Date of Patent: *Mar. 7, 2017**

(54) LIQUID COMPOSITION

(71) Applicant: SHELL OIL COMPANY, Houston, TX (US)

(72) Inventor: Mark Lawrence Brewer, Manchester (GB)

(73) Assignee: SHELL OIL COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/571,919

(22) Filed: Dec. 16, 2014

(65) Prior Publication Data

US 2015/0166920 A1 Jun. 18, 2015

(30) Foreign Application Priority Data

Dec. 16, 2013 (EP) ..... 13197546

(51) Int. Cl.

| | |
|---|---|
| ***C10L 1/19*** | (2006.01) |
| ***C10L 10/14*** | (2006.01) |
| ***C10L 10/12*** | (2006.01) |
| ***C10L 1/14*** | (2006.01) |
| *C10L 1/228* | (2006.01) |
| *C10L 1/223* | (2006.01) |
| *C10L 1/185* | (2006.01) |
| *C10L 1/188* | (2006.01) |
| *C10L 1/189* | (2006.01) |
| *C10L 1/232* | (2006.01) |

(52) U.S. Cl.

CPC ..... *C10L 10/14* (2013.01); *C10L 1/14* (2013.01); *C10L 10/12* (2013.01); *C10L 1/189* (2013.01); *C10L 1/1857* (2013.01); *C10L 1/1883* (2013.01); *C10L 1/19* (2013.01); *C10L 1/191* (2013.01); *C10L 1/1905* (2013.01); *C10L 1/223* (2013.01); *C10L 1/2286* (2013.01); *C10L 1/232* (2013.01); *C10L 2270/02* (2013.01)

(58) Field of Classification Search

USPC ..... 44/388, 400

See application file for complete search history.

(56) References Cited

U.S. PATENT DOCUMENTS

| | | | | |
|---|---|---|---|---|
| 4,208,190 | A | 6/1980 | Malec | |
| 4,444,567 | A * | 4/1984 | Burns | C10L 1/19 44/400 |
| 4,684,373 | A * | 8/1987 | Vataru | C10L 1/14 44/322 |
| 4,849,572 | A | 7/1989 | Chen et al. | |
| 4,877,416 | A | 10/1989 | Campbell | |
| 5,378,348 | A | 1/1995 | David et al. | |
| 5,490,864 | A | 2/1996 | Herbstman et al. | |
| 5,766,274 | A | 6/1998 | Wittenbrink et al. | |
| 5,855,629 | A | 1/1999 | Grundy et al. | |
| 5,888,376 | A | 3/1999 | Wittenbrink et al. | |
| 6,204,426 | B1 | 3/2001 | Miller et al. | |
| 7,166,275 | B2 * | 1/2007 | Bertz | A01N 25/02 424/59 |
| 8,603,200 | B2 * | 12/2013 | Aradi | C10L 1/231 44/354 |
| 2005/0008586 | A1 | 1/2005 | Bertz et al. | |
| 2005/0044778 | A1 * | 3/2005 | Orr | C10L 1/12 44/320 |
| 2012/0010112 | A1 | 1/2012 | Grabarse et al. | |
| 2012/0102826 | A1 | 5/2012 | Fang | |
| 2013/0225463 | A1 | 8/2013 | Hansch et al. | |
| 2013/0296210 | A1 | 11/2013 | Hansch et al. | |
| 2015/0113857 | A1 * | 4/2015 | Brewer | C10L 1/232 44/336 |
| 2015/0113858 | A1 * | 4/2015 | Brewer | C10L 1/232 44/336 |

FOREIGN PATENT DOCUMENTS

| | | |
|---|---|---|
| DE | 3826608 | 2/1990 |
| DE | 3838918 | 5/1990 |
| DE | 4142241 | 6/1993 |
| DE | 4309074 | 9/1994 |
| DE | 19620262 | 11/1997 |
| EP | 147240 | 7/1985 |
| EP | 310875 | 4/1989 |
| EP | 356725 | 3/1990 |
| EP | 452328 | 3/1991 |
| EP | 482253 | 4/1992 |
| EP | 548617 | 6/1993 |
| EP | 613938 | 9/1994 |
| EP | 700985 | 3/1996 |

(Continued)

OTHER PUBLICATIONS

Finsolv PG-22—Dipropylene Glycol Dibenzoate, Apr. 1, 2010 (Apr. 1, 2010), XP055104077, Retrieved from the Internet:URL:http://tempo.ca/wp-content/uploads/2013/06/ FINSOLV-PG-22-TDS-10-01-01.pdf [retrieved on Feb. 25, 2014].

European Extended Search Report for EP Application No. 13197546.8 dated Mar. 6, 2014.

Sagarin, et al., at Chapter VIII, pp. 189 et seq., of Cosmetics Science and Technology (1972).

Danping Wei, et al.; The Lubricity of Diesel Fuels, Wear, III (1986), pp. 217-235.

*Primary Examiner* — Ellen McAvoy

(57) ABSTRACT

A liquid fuel composition comprising a base fuel suitable for use in an internal combustion engine; one or more organic UV filter compounds; and one or more ester co-additive compounds provides improvements in terms of stability properties in an additive blend containing said one or more organic UV filter compounds and said one or more ester co-additive compounds, particularly at low temperatures, such as temperatures of 5° C. or lower.

13 Claims, No Drawings

(56) References Cited

FOREIGN PATENT DOCUMENTS

| | | |
|---|---|---|
| EP | 557516 | 7/1996 |
| EP | 831141 | 3/1998 |
| EP | 1101813 | 5/2001 |
| EP | 583836 | 2/2002 |
| EP | 2267103 | 12/2010 |
| GB | 960493 | 6/1964 |
| GB | 2493377 | 2/2013 |
| WO | 9424231 | 10/1994 |
| WO | 9533805 | 12/1995 |
| WO | 9603397 | 2/1996 |
| WO | 9703946 | 2/1997 |
| WO | 9714768 | 4/1997 |
| WO | 9714769 | 4/1997 |
| WO | 9801516 | 1/1998 |
| WO | 9842808 | 10/1998 |
| WO | 9932584 | 7/1999 |
| WO | 0011116 | 3/2000 |
| WO | 0011117 | 3/2000 |
| WO | 0020534 | 4/2000 |
| WO | 0020535 | 4/2000 |
| WO | 0140412 | 6/2001 |
| WO | 0183406 | 11/2001 |
| WO | 0183641 | 11/2001 |
| WO | 0183647 | 11/2001 |
| WO | 0183648 | 11/2001 |
| WO | 03076554 | 9/2003 |
| WO | 2006135881 | 12/2006 |
| WO | 2008135602 | 11/2008 |
| WO | 2009050287 | 4/2009 |
| WO | 2009077606 | 6/2009 |
| WO | 2010000761 | 1/2010 |
| WO | 2010028206 | 3/2010 |
| WO | 2011095819 | 8/2011 |
| WO | 2011110860 | 9/2011 |
| WO | 2011149799 | 12/2011 |
| WO | 2012163935 | 12/2012 |

* cited by examiner

LIQUID COMPOSITION

This non-provisional application claims the benefit of European Application No. 13197546.8 filed Dec. 16, 2013 which is hereby incorporated by reference in its entirety.

FIELD OF THE INVENTION

The present invention relates to a liquid fuel composition, in particular to a liquid fuel composition having improved formulation stability properties.

BACKGROUND OF THE INVENTION

European patent applications 12199119.4, 13190062.3 and 13190063.1, and U.S. provisional application 61/740,535 relate to the use of organic sunscreens/UV filter compounds in liquid fuel compositions. In particular, European patent applications 13190062.3 and 12199119.4 relate to the use of organic sunscreens/UV filter compounds to modify the ignition delay and/or increase the cetane number and/or modify the burn period and/or modify the peak pressure in diesel fuel compositions. European patent application 13190063.1 and U.S. provisional application 61/740,535 relate to the use of organic sunscreens/UV filter compounds in gasoline fuel compositions for providing benefits such as increased flame speed, improved power output and improved acceleration performance.

While organic UV filter/absorber compounds can provide the above-mentioned performance benefits, it is recognized that there can be stability issues around the inclusion of organic UV filter/absorber compounds in liquid fuel compositions and/or in additive packages/blends for use in liquid fuel compositions. It is therefore desirable to provide improvements in the stability properties, particularly at lower temperatures, of liquid fuel compositions and additive packages/blends containing such UV filter compounds. Low temperature stability properties of fuels can be assessed by standard methods such as cloud points, pour points, CFPP (cold filter plugging point), filterability tests, storage stability tests and visual inspection.

SUMMARY OF THE INVENTION

According to the present invention there is provided a liquid fuel composition comprising:

(a) a base fuel suitable for use in an internal combustion engine;

(b) one or more organic UV filter compounds; and (c) one or more ester co-additive compounds selected from esters of glycols and benzoic acid, esters of monoalcohols and benzoic acid, esters of polyalcohols and benzoic acid, esters of monoalcohols and monocarboxylic acids prepared by the reaction of a $C_4$-$C_{18}$ branched or straight-chain monocarboxylic acid with a $C_4$-$C_{18}$ branched or straight chain monoalcohol, and esters of monoalcohols and dicarboxylic acids prepared by the reaction of a $C_4$-$C_{12}$ branched or straight chain dicarboxylic acid with a $C_3$-$C_{18}$ branched or straight chain monoalcohol, and mixtures thereof.

According to another aspect of the present invention there is provided an additive blend suitable for use in a liquid fuel composition wherein the additive blend comprises (i) one or more organic UV filter compounds; (ii) one or more ester co-additive compounds selected from esters of glycols and benzoic acid, esters of monoalcohols and benzoic acid, esters of polyalcohols and benzoic acid, esters of monoalcohols and monocarboxylic acids prepared by the reaction of a $C_4$-$C_{18}$ branched or straight-chain monocarboxylic acid with a $C_4$-$C_{18}$ branched or straight chain monoalcohol, and esters of monoalcohols and dicarboxylic acids prepared by the reaction of a $C_4$-$C_{12}$ branched or straight chain dicarboxylic acid with a $C_3$-$C_{18}$ branched or straight chain monoalcohol, and mixtures thereof; and one or more detergents.

It has been found that the liquid fuel compositions and the additive blends of the present invention exhibit improved stability properties compared to liquid fuel compositions and additive blends comprising organic UV filter compounds, but not containing one or more ester co-additive compounds.

DETAILED DESCRIPTION OF THE INVENTION

The liquid fuel composition of the present invention comprises a base fuel suitable for use in an internal combustion engine, one or more organic UV filter compounds and one or more ester co-additive compounds. The base fuel is preferably selected from a gasoline base fuel or a diesel base fuel. If the base fuel is a gasoline base fuel then the liquid fuel composition of the present invention is a gasoline composition. If the base fuel is a diesel base fuel then the liquid fuel composition of the present invention is a diesel composition.

There is no particular limitation on the type of organic UV filter compound which can be used in the present invention as long as it is suitable for use in a gasoline or diesel fuel composition.

As used herein the term 'organic UV filter compounds' is also intended to encompasses organic UV absorber compounds and organic sunscreen compounds.

A wide variety of conventional organic sunscreen actives are suitable for use herein as the organic UV filter compound. Sagarin, et al., at Chapter VIII, pages 189 et seq., of Cosmetics Science and Technology (1972) and 'The Encyclopedia of Ultraviolet Filters' by Nadim A. Shaath disclose numerous suitable actives. Particularly preferred hydrophobic organic sunscreen actives useful as the organic UV filter compound in the liquid fuel compositions and additive blends of the present invention include: (i) alkyl β,β-diphenylacrylate and/or alpha-cyano-beta,beta-diphenylacrylate derivatives; (ii) salicylic derivatives; (iii) cinnamic derivatives; (iv) dibenzoylmethane derivatives; (v) camphor derivatives; (vi) benzophenone derivatives; (vii) p-aminobenzoic acid derivatives; and (viii) phenalkyl benzoate derivatives; and (ix) compounds selected from the group consisting of imidazoles, triazines, triazones and triazoles; and mixtures thereof.

Preferred alpha-cyano-beta,beta-diphenylacrylate derivatives include ethyl 2-cyano-3,3-diphenylacrylate, 2-ethylhexyl 2-cyano-3,3-diphenylacrylate, and mixtures thereof. More preferably the alpha-cyano-beta,beta-diphenylacrylate derivative is 2-ethylhexyl 2-cyano-3,3-diphenylacrylate, of which the International Non Proprietary Name is Octocrylene. 2-ethylhexyl 2-cyano-3,3-diphenylacrylate is commercially available under the tradename Parsol 340® from DSM Nutritional Products, Inc.

Preferred salicylate derivatives include ethylhexyl salicylate (octyl salicylate), triethanolamine salicylate, 3,3,5-trimethylcyclohexylsalicylate, homomenthyl salicylate, and mixtures thereof. More preferably, the salicylate derivative is ethylhexyl salicylate. Ethylhexyl salicylate is commercially available under the tradename Parsol EHS® from DSM Nutritional Products, Inc.

Preferred cinnamic derivatives are selected from octylmethoxy cinnamate, diethanolamine methoxycinnamate, and mixtures thereof. A particularly preferred cinnamic derivative for use herein is octylmethoxy cinnamate. Octylmethoxy cinnamate is commercially available under the tradename Parsol MCX® from DSM Nutritional Products, Inc.

Preferred dibenzoylmethane derivatives for use herein are selected from butyl methoxy dibenzoylmethane, ethylhexyl methoxy dibenzoylmethane, isopropyl dibenzoylmethane, and mixtures thereof. A particularly preferred dibenzoylmethane derivative for use herein is butyl methoxy dibenzoylmethane. Butyl methoxy dibenzoylmethane is commercially available under the tradename Parsol 1789® from DSM Nutritional Products, Inc.

A preferred camphor derivative for use herein is 4-methylbenzylidene camphor. 4-methylbenzylidene camphor is commercially available under the tradename Parsol 5000® from DSM Nutritional Products, Inc.

Preferred benzophenone derivatives for use herein are selected from benzophenone-1, benzophenone-2, benzophenone-3, benzophenone-4, benzophenone-5, benzophenone-6, benzophenone-7, benzophenone-8, benzophenone-9, benzophenone-10, benzophenone-11, benzophenone-12, and mixtures thereof. A particularly preferred benzophenone derivative for use herein is benzophenone-3. Benzophenone-3 is commercially available under the tradename Escalol 567® from Ashland Specialty Ingredients.

A preferred phenalkyl benzoate derivatives for use herein is phenethyl benzoate. Phenethyl benzoate is commercially available under the tradename X-tend 229® from Ashland Specialty Ingredients.

Preferred imidazoles include, but are not necessarily limited to, disodium phenyl dibenzylimidazole tetrasulfonate, (commercially available from Symrise under the tradename Neoheliopan AP), ethyl hexyl dimethoxybenzylidene dioxoimidazoline propionate, phenylbenzimidazole sulfonic acid (commercially available from DSM under the tradename Parsol HS), and mixtures thereof.

Preferred triazines include, but are not necessarily limited to, phenyl triazines such as bis-ethylhexyloxyphenol methoxyphenyl triazine (commercially available from BASF under the tradename Tinasorb S), bis benzoxazoyl phenyl ethylhexyl aminotriazine (commercially available from 3V Sigma under the tradename Uvasorb K2A), and mixtures thereof.

Preferred triazoles include, but are not necessarily limited to, drometrizole, (commercially available from BASF under the tradename Tinuvin P) and ethylene bis-benzotriazolyl tetramethylbutylphenol (commercially available from BASF under the tradename Tinosorb M), and mixtures thereof.

Preferred triazones, include, but are not necessarily limited to, diethyl hexyl butamido triazone (commercially available from 3V Sigma under the tradename Uvasorb HEB), ethyl hexyl triazone (commercially available from BASF under the tradename Uvinul T150), and mixtures thereof.

The total level of the one or more organic UV filter compounds is at most 2 wt %, by weight of the liquid fuel composition. The total level of the one or more organic UV filter compounds is at least 10 ppmw, by weight of the liquid fuel composition. The total level of the one or more organic UV filter compounds is preferably in the range of from 1 wt % to 0.005 wt %, more preferably in the range of from 0.5 wt % to 0.01 wt %, even more preferably in the range of from 0.05 wt % to 0.01 wt %, by weight of the liquid fuel composition.

Another essential component of the liquid fuel compositions of the present invention is one or more ester co-additive compounds. The one or more ester co-additive compounds is selected from esters of glycols and benzoic acid, esters of monoalcohols and benzoic acid, esters of polyalcohols and benzoic acid, esters of monoalcohols and monocarboxylic acids prepared by the reaction of a $C_4$-$C_{18}$ branched or straight-chain monocarboxylic acid with a $C_4$-$C_{18}$ branched or straight chain monoalcohol, and esters of monoalcohols and dicarboxylic acids prepared by the reaction of a $C_4$-$C_{12}$ branched or straight chain dicarboxylic acids with a $C_3$-$C_{18}$ branched or straight chain monoalcohol, and mixtures thereof.

Glycol esters of benzoic acid are prepared from the reaction of benzoic acid with a monoalkylene glycol or polyalkyene glycol, and various conventional monoalkylene glycols and polyalkylene glycols may be conveniently used.

Preferred glycol compounds for use in the present invention are those having (—R—O—) alkylene oxide units as monomer units wherein R is a $C_1$-$C_6$ alkylene group. Preferred glycol compounds are those having from 1 to 8 such monomer units. Particularly preferred glycol compounds for use herein are selected from monoethyleneglycol, diethyleneglycol, triethyleneglycol, monopropyleneglycol, dipropylene glycol, neopentyl glycol, and mixtures thereof.

Esters of benzoic acid and monoalcohols are preferably prepared from the reaction of benzoic acid with a $C_3$-$C_{16}$ branched chain monoalcohol or a $C_2$-$C_{16}$ straight chain monoalcohol, preferably, a $C_3$-$C_{16}$ branched monoalcohol, more preferably a $C_4$-$C_{10}$ branched monoalcohol.

Esters of benzoic acid and polyalcohols are preferably prepared from the reaction of benzoic acid with a polyalcohol selected from glycerol, TMP (trimethanolpropane) alcohol, pentaerythritol and mixtures thereof.

The ester co-additive compound can also be an ester of a monocarboxylic acid with a monoalcohol prepared by the reaction of a $C_4$-$C_{18}$ branched or straight-chain monocarboxylic acid with a $C_4$-$C_{18}$ branched or straight chain monoalcohol, an ester of a dicarboxylic acid with a monoalcohol prepared by the reaction of a $C_4$-$C_{12}$ branched or straight chain dicarboxylic acid with a $C_3$-$C_{18}$ branched or straight chain monoalcohol, and mixtures thereof. In a particularly preferred embodiment herein, the $C_4$-$C_{18}$ branched or straight chain monocarboxylic acid is 2-ethyl hexanoic acid. In another particularly preferred embodiment herein the $C_4$-$C_{12}$ branched or straight chain dicarboxylic acid is selected from maleic acid, sebacic acid, azelaic acid, and mixtures thereof, more preferably maleic acid.

Particularly preferred ester co-additives for use herein are selected from $C_{12}$-$C_{15}$ Alkyl Ethylhexanoate (commercially available from Innospec under the trade name Activemol EH-25), bis(2-ethylhexyl)maleate (commercially available from Innospec under the trade name Activemol DOM-R), dipropylene glycol dibenzoate (commercially available from Innospec under the tradename Finsolv PG-22) and 2-ethyl-1-hexanol benzoate (commercially available from Innospec under the tradename Finsolve EB).

In liquid fuel compositions of the present invention the total level of the one or more ester co-additives is in the range of from 0.001 wt % to 0.5 wt %, preferably from 0.005 wt % to 0.1 wt %, and more preferably from 0.005 wt % to 0.05 wt %, by weight of the liquid fuel composition.

In another embodiment, the total level of the one or more ester co-additives is in the range of from 0.05 wt % to 0.1 wt %, by weight of the liquid fuel composition.

In preferred liquid fuel compositions of the present invention the weight ratio of the one or more organic UV filter compounds to the one or more ester co-additive compounds is in the range from 9:1 to 1:9, more preferably in the range from 5:1 to 1:2, even more preferably in the range from 4:1 to 1:1.

The organic UV filter compound and the ester co-additive compound may be blended together with any other additives e.g. additive performance package(s) to produce an additive blend. The additive blend can then be added to a base fuel to produce a liquid fuel composition.

Hence according to another aspect of the present invention there is provided an additive blend suitable for use in a liquid fuel composition wherein the additive blend comprises one or more organic UV filter compounds; one or more ester co-additive compounds; and one or more detergents. In preferred additive blends, further additives such as anti-foaming agents, corrosion inhibitors, dehazers, and the like, are included in the additive blend in addition to the organic UV filter compound, ester co-additive compound, and detergent, for example in the form of an additive performance package. The detergent component itself can also be included in the form of an additive performance package.

Alternatively, the organic UV filter compound and the ester co-additive may be blended directly with the base fuel.

During preparation of the additive blend, the one or more organic UV filters, the one or more ester co-additive compounds and an additive (detergent) performance package, can be combined in any order. For example, an additive performance package can be combined with the one or more organic UV filter compounds and the one or more ester co-additive compounds can be added subsequently.

The amount of organic UV filter compound in the additive blend is preferably in the range of from 0.1 wt % to 99.8 wt %, more preferably in the range of from 5 wt % to 50 wt %, by weight of the additive blend.

The total level of the one or more ester co-additives in the additive blend is preferably in the range of from 5 wt % to 70 wt %, more preferably from 5 wt % to 50 wt %, even more preferably from 10 wt % to 40 wt %, by weight of the additive blend.

It has surprisingly been found by the present inventors that the use of the one or more ester co-additive compounds in combination with the one or more organic UV filter compounds provides improvements in terms of stability properties in an additive blend containing said one or more organic filter compounds and said one or more ester co-additive compounds, particularly at low temperatures, such as temperatures of 5° C. or below, or alternatively at temperatures of 0° C. or below, at temperatures of −5° C. or below, at temperatures of −10° C. or below, at temperatures of −15° C. or below, at temperatures of −20° C. or below, down to temperatures of −25° C.

Hence, according to another aspect of the present invention there is provided use of one or more ester co-additive compounds selected from esters of glycols and benzoic acid, esters of monoalcohols and benzoic acid, esters of polyalcohols and benzoic acid, esters of monoalcohols and monocarboxylic acids prepared by the reaction of a $C_4$-$C_{18}$ branched or straight-chain monocarboxylic acid with a $C_4$-$C_{18}$ branched or straight chain monoalcohol, and esters of monoalcohols and dicarboxylic acids prepared by the reaction of a $C_4$-$C_{12}$ branched or straight chain dicarboxylic acid with a $C_3$-$C_{18}$ branched or straight chain monoalcohol for stability properties of an additive blend, in particular at low temperatures, wherein the additive blend comprises one or more organic UV filter compounds and one or more said ester co-additive compounds.

An optional, but preferred component of the additive blend, in addition to the organic UV filter compound and the ester co-additive compound is a solvent. There are no particular limitations as to the type of solvent which may be used in the present invention, provided it is suitable for use in the additive blend. The use of a solvent in the additive blend in addition to the one or more ester co-additive compounds and the one or more organic UV filter compounds provides improved stability properties and reduce viscosity.

Any solvent or mixtures of solvents suitable for use in fuels may be used herein. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Further examples of suitable solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

The solvent is preferably present at a level of from 5 wt % to 50 wt %, more preferably at a level of from 5 wt % to 20 wt %, by weight of the additive blend (not including any solvent present in the performance additive package).

The amount of detergent or performance package(s) in the additive blend is preferably in the range of from 0.1 to 99.8 wt %, more preferably in the range of from 5 to 50 wt %, by weight of the additive blend.

Preferably, the amount of the detergent or performance package present in the liquid fuel composition of the present invention is in the range of 15 ppmw (parts per million by weight) to 10% wt, based on the overall weight of the liquid fuel composition. More preferably, the amount of the detergent or performance package present in the liquid fuel composition of the present invention additionally accords with one or more of the parameters (i) to (xv) listed below:

(i) at least 100 ppmw
(ii) at least 200 ppmw
(iii) at least 300 ppmw
(iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 5000 ppmw
(xiii) at most 10000 ppmw
(xiv) at most 2% wt.
(xv) at most 5% wt.

The remainder of the composition will typically consist of one or more automotive base fuels optionally together with one or more fuel additives, for instance as described in more detail below.

Conventionally base fuels are present in a liquid fuel composition in a major amount, for example greater than 50 wt % of the liquid fuel composition, and may be present in an amount of up to 90 wt %, or 95 wt %, or 99 wt %, or 99.9 wt %, or 99.99 wt %, or 99.999 wt %. Suitably the liquid fuel composition contains or consists essentially of the base fuel in conjunction with the one or more organic UV filter compounds and the one or more ester co-additive compounds, and optionally one or more conventional fuel additives, such as specified hereinafter.

The relative proportions of the one or more organic UV filter compounds, one or more ester co-additive compounds, base fuel components and any other components or additives present in a liquid fuel composition prepared according to the invention may also depend on other desired properties such as density, emissions performance and viscosity.

If the liquid fuel compositions of the present invention contain a gasoline base fuel, the liquid fuel composition is a gasoline fuel composition. The gasoline may be any gasoline suitable for use in an internal combustion engine of the spark-ignition (petrol) type known in the art, including automotive engines as well as in other types of engine such as, for example, off road and aviation engines. The gasoline used as the base fuel in the liquid fuel composition of the present invention may conveniently also be referred to as 'base gasoline'.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline may be at least 80, for instance in the range of from 80 to 110, preferably the RON of the gasoline will be at least 90, for instance in the range of from 90 to 110, more preferably the RON of the gasoline will be at least 91, for instance in the range of from 91 to 105, even more preferably the RON of the gasoline will be at least 92, for instance in the range of from 92 to 103, even more preferably the RON of the gasoline will be at least 93, for instance in the range of from 93 to 102, and most preferably the RON of the gasoline will be at least 94, for instance in the range of from 94 to 100 (EN 25164); the motor octane number (MON) of the gasoline may conveniently be at least 70, for instance in the range of from 70 to 110, preferably the MON of the gasoline will be at least 75, for instance in the range of from 75 to 105, more preferably the MON of the gasoline will be at least 80, for instance in the range of from 80 to 100, most preferably the MON of the gasoline will be at least 82, for instance in the range of from 82 to 95 (EN 25163).

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40 percent by volume based on the gasoline (ASTM D1319); preferably, the olefinic hydrocarbon content of the gasoline is in the range of from 0 to 30 percent by volume based on the gasoline, more preferably, the olefinic hydrocarbon content of the gasoline is in the range of from 0 to 20 percent by volume based on the gasoline.

Typically, the aromatic hydrocarbon content of the gasoline is in the range of from 0 to 70 percent by volume based on the gasoline (ASTM D1319), for instance the aromatic hydrocarbon content of the gasoline is in the range of from 10 to 60 percent by volume based on the gasoline; preferably, the aromatic hydrocarbon content of the gasoline is in the range of from 0 to 50 percent by volume based on the gasoline, for instance the aromatic hydrocarbon content of the gasoline is in the range of from 10 to 50 percent by volume based on the gasoline.

The benzene content of the gasoline is at most 10 percent by volume, more preferably at most 5 percent by volume, especially at most 1 percent by volume based on the gasoline.

The gasoline preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably has a low total lead content, such as at most 0.005 g/l, most preferably being lead free—having no lead compounds added thereto (i.e. unleaded).

When the gasoline comprises oxygenated hydrocarbons, at least a portion of non-oxygenated hydrocarbons will be substituted for oxygenated hydrocarbons. The oxygen content of the gasoline may be up to 35 percent by weight (EN 1601) (e.g. ethanol per se) based on the gasoline. For example, the oxygen content of the gasoline may be up to 25 percent by weight, preferably up to 10 percent by weight. Conveniently, the oxygenate concentration will have a minimum concentration selected from any one of 0, 0.2, 0.4, 0.6, 0.8, 1.0, and 1.2 percent by weight, and a maximum concentration selected from any one of 5, 4.5, 4.0, 3.5, 3.0, and 2.7 percent by weight.

Examples of oxygenated hydrocarbons that may be incorporated into the gasoline include alcohols, ethers, esters, ketones, aldehydes, carboxylic acids and their derivatives, and oxygen containing heterocyclic compounds. Preferably, the oxygenated hydrocarbons that may be incorporated into the gasoline are selected from alcohols (such as methanol, ethanol, propanol, 2-propanol, butanol, tert-butanol, isobutanol and 2-butanol), ethers (preferably ethers containing 5 or more carbon atoms per molecule, e.g., methyl tert-butyl ether and ethyl tert-butyl ether) and esters (preferably esters containing 5 or more carbon atoms per molecule); a particularly preferred oxygenated hydrocarbon is ethanol.

When oxygenated hydrocarbons are present in the gasoline, the amount of oxygenated hydrocarbons in the gasoline may vary over a wide range. For example, gasolines comprising a major proportion of oxygenated hydrocarbons are currently commercially available in countries such as Brazil and U.S.A., e.g. ethanol per se and E85, as well as gasolines comprising a minor proportion of oxygenated hydrocarbons, e.g. E10 and E5. Therefore, the gasoline may contain up to 100 percent by volume oxygenated hydrocarbons. E100 fuels as used in Brazil are also included herein. Preferably, the amount of oxygenated hydrocarbons present in the gasoline is selected from one of the following amounts: up to 85 percent by volume; up to 70 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline may contain at least 0.5, 1.0 or 2.0 percent by volume oxygenated hydrocarbons.

Examples of suitable gasolines include gasolines which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Also suitable for use herein are gasoline blending components which can be derived from a biological source. Examples of such gasoline blending components can be found in WO2009/077606, WO2010/028206, WO2010/000761, European patent application nos. 09160983.4, 09176879.6, 09180904.6, and U.S. patent application Ser. No. 61/312,307.

If the liquid fuel composition of the present invention contains a diesel base fuel, the liquid fuel composition is a diesel fuel composition.

The diesel fuel used as the base fuel in the present invention includes diesel fuels for use in automotive compression ignition engines, as well as in other types of engine such as for example off road, marine, railroad and stationary engines. The diesel fuel used as the base fuel in the liquid fuel composition of the present invention may conveniently also be referred to as 'diesel base fuel'.

The diesel base fuel may itself comprise a mixture of two or more different diesel fuel components, and/or be additivated as described below.

Such diesel fuels will contain one or more base fuels which may typically comprise liquid hydrocarbon middle distillate gas oil(s), for instance petroleum derived gas oils. Such fuels will typically have boiling points within the usual diesel range of 150 to 400° C., depending on grade and use. They will typically have a density from 750 to 1000 kg/m$^3$, preferably from 780 to 860 kg/m$^3$, at 15° C. (e.g. ASTM D4502 or IP 365) and a cetane number (ASTM D613) of from 35 to 120, more preferably from 40 to 85. They will typically have an initial boiling point in the range 150 to 230° C. and a final boiling point in the range 290 to 400° C. Their kinematic viscosity at 40° C. (ASTM D445) might suitably be from 1.2 to 4.5 mm$^2$/s.

An example of a petroleum derived gas oil is a Swedish Class 1 base fuel, which will have a density from 800 to 820 kg/m$^3$ at 15 C (SS-EN ISO 3675, SS-EN ISO 12185), a T95 of 320° C. or less (SS-EN ISO 3405) and a kinematic viscosity at 40° C. (SS-EN ISO 3104) from 1.4 to 4.0 mm$^2$/s, as defined by the Swedish national specification EC1.

Optionally, non-mineral oil based fuels, such as biofuels or Fischer-Tropsch derived fuels, may also form or be present in the diesel fuel. Such Fischer-Tropsch fuels may for example be derived from natural gas, natural gas liquids, petroleum or shale oil, petroleum or shale oil processing residues, coal or biomass.

The amount of Fischer-Tropsch derived fuel used in the diesel fuel may be from 0% to 100% v of the overall diesel fuel, preferably from 5% to 100% v, more preferably from 5% to 75% v. It may be desirable for such a diesel fuel to contain 10% v or greater, more preferably 20% v or greater, still more preferably 30% v or greater, of the Fischer-Tropsch derived fuel. It is particularly preferred for such diesel fuels to contain 30 to 75% v, and particularly 30 to 70% v, of the Fischer-Tropsch derived fuel. The balance of the diesel fuel is made up of one or more other diesel fuel components.

Such a Fischer-Tropsch derived fuel component is any fraction of the middle distillate fuel range, which can be isolated from the (optionally hydrocracked) Fischer-Tropsch synthesis product. Typical fractions will boil in the naphtha, kerosene or gas oil range. Preferably, a Fischer-Tropsch product boiling in the kerosene or gas oil range is used because these products are easier to handle in for example domestic environments. Such products will suitably comprise a fraction larger than 90 wt % which boils between 160 and 400° C., preferably to about 370° C. Examples of Fischer-Tropsch derived kerosene and gas oils are described in EP-A-0583836, WO-A-97/14768, WO-A-97/14769, WO-A-00/11116, WO-A-00/11117, WO-A-01/83406, WO-A-01/83648, WO-A-01/83647, WO-A-01/83641, WO-A-00/20535, WO-A-00/20534, EP-A-1101813, U.S. Pat. No. 5,766,274, U.S. Pat. No. 5,378,348, U.S. Pat. No. 5,888,376 and U.S. Pat. No. 6,204,426.

The Fischer-Tropsch product will suitably contain more than 80 wt % and more suitably more than 95 wt % iso and normal paraffins and less than 1 wt % aromatics, the balance being naphthenics compounds. The content of sulphur and nitrogen will be very low and normally below the detection limits for such compounds. For this reason the sulphur content of a diesel fuel composition containing a Fischer-Tropsch product may be very low.

The diesel fuel composition preferably contains no more than 5000 ppmw sulphur, more preferably no more than 500 ppmw, or no more than 350 ppmw, or no more than 150 ppmw, or no more than 100 ppmw, or no more than 70 ppmw, or no more than 50 ppmw, or no more than 30 ppmw, or no more than 20 ppmw, or most preferably no more than 10 ppmw sulphur.

Other diesel fuel components for use herein include the so-called "biofuels" which derive from biological materials. Examples include fatty acid alkyl esters (FAAE). Examples of such components can be found in WO2008/135602.

The diesel base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents.

Whilst not critical to the present invention, the base fuel or the liquid fuel composition of the present invention may conveniently include one or more optional fuel additives, in addition to the essential one or more organic UV filter compounds and the one or more ester co-additive compounds mentioned above, either as part of a performance additive package, or otherwise. The concentration and nature of the optional fuel additive(s) that may be included in the base fuel or the liquid fuel composition of the present invention is not critical.

Gasoline Additives

Non-limiting examples of suitable types of fuel additives that can be included in the base gasoline, or the performance additive package, or the gasoline composition or the additive blend of the present invention include anti-oxidants, corrosion inhibitors, detergents, dehazers, antiknock additives, metal deactivators, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the base gasoline or the gasoline composition of the present invention.

The (active matter) concentration of any optional additives present in the base gasoline or the gasoline composition of the present invention is preferably up to 1 percent by weight, more preferably in the range from 5 to 2000 ppmw, advantageously in the range of from 300 to 1500 ppmw, such as from 300 to 1000 ppmw.

As stated above, the gasoline composition may also contain synthetic or mineral carrier oils and/or solvents.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly (internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the hazing that might otherwise occur when the gasoline without the dehazer contacts water, and this amount will be referred to herein as a "haze-inhibiting amount." Generally, this amount is from about 0.1 to about 20 ppmw (e.g. from about 0.1 to about 10 ppm), more preferably from 1 to 15 ppmw, still more preferably from 1 to 10 ppmw, advantageously from 1 to 5 ppmw based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g. p-phenylenediamine, N,N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclo-pentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO 03/076554.

Optionally anti valve seat recession additives may be used such as sodium or potassium salts of polymeric organic acids.

The gasoline compositions herein can also comprise a detergent additive. Suitable detergent additives include those disclosed in WO2009/50287, incorporated herein by reference.

Preferred detergent additives for use in the gasoline composition herein typically have at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties;

(A6) polyoxy-$C_2$- to -$C_4$-alkylene groups which are terminated by hydroxyl groups, mono- or polyamino groups, in which at least one nitrogen atom has basic properties, or by carbamate groups;

(A8) moieties derived from succinic anhydride and having hydroxyl and/or amino and/or amido and/or imido groups; and/or (A9) moieties obtained by Mannich reaction of substituted phenols with aldehydes and mono- or polyamines.

The hydrophobic hydrocarbon radical in the above detergent additives, which ensures the adequate solubility in the base fluid, has a number-average molecular weight (Mn) of from 85 to 20 000, especially from 113 to 10 000, in particular from 300 to 5000. Typical hydrophobic hydrocarbon radicals, especially in conjunction with the polar moieties (A1), (A8) and (A9), include polyalkenes (polyolefins), such as the polypropenyl, polybutenyl and polyisobutenyl radicals each having Mn of from 300 to 5000, preferably from 500 to 2500, more preferably from 700 to 2300, and especially from 700 to 1000.

Non-limiting examples of the above groups of detergent additives include the following:

Additives comprising mono- or polyamino groups (A1) are preferably polyalkenemono- or polyalkenepolyamines based on polypropene or conventional (i.e. having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylenetriamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further preferred additives comprising monoamino groups (A1) are the compounds obtainable from polyisobutene epoxides by reaction with amines and subsequent dehydration and reduction of the amino alcohols, as described in particular in DE-A-196 20 262.

Additives comprising polyoxy-$C_2$-$C_4$-alkylene moieties (A6) are preferably polyethers or polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyether-amines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising moieties derived from succinic anhydride and having hydroxyl and/or amino and/or amido and/or imido groups (A8) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine. Such additives are described in particular in U.S. Pat. No. 4,849,572.

Additives comprising moieties obtained by Mannich reaction of substituted phenols with aldehydes and mono- or polyamines (A9) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Preferably, the detergent additive used in the gasoline compositions of the present invention contains at least one nitrogen-containing detergent, more preferably at least one nitrogen-containing detergent containing a hydrophobic hydrocarbon radical having a number average molecular weight in the range of from 300 to 5000. Preferably, the nitrogen-containing detergent is selected from a group comprising polyalkene monoamines, polyetheramines, polyalkene Mannich amines and polyalkene succinimides. Conveniently, the nitrogen-containing detergent may be a polyalkene monoamine.

The above nitrogen containing detergents/amine detergents can be reacted to form quaternary ammonium salts which can themselves be used as alternative detergents. Suitable quaternary ammonium salts for use in gasoline fuel compositions include those disclosed in WO2006/135881, WO2011/149799, GB-A-2493377, US2013/296210 and US2013/225463.

The gasoline fuel and gasoline performance packages compositions can also comprise friction modifiers, viscosity control agents, and mixtures thereof, such as those disclosed in WO2012163935.

In the above, amounts (concentrations, % vol, ppmw, % wt) of components are of active matter, i.e. exclusive of volatile solvents/diluent materials.

Diesel Additives

Detergent-containing diesel fuel additives are known and commercially available. Such additives may be added to diesel fuels at levels intended to reduce, remove, or slow the build-up of engine deposits.

Examples of detergents suitable for use in diesel fuel additives for the present purpose include polyolefin substituted succinimides or succinamides of polyamines, for instance polyisobutylene succinimides or polyisobutylene amine succinamides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

Other examples of detergents suitable for use in diesel fuel additives for the present purpose include compounds having at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties; and/or (A9) moieties obtained by Mannich reaction of substituted phenols with aldehydes and mono- or polyamines.

Other detergents suitable for use in diesel fuel additives for the present purpose include quaternary ammonium salts such as those disclosed in US2012/0102826, US2012/0010112, WO2011/149799, WO2011/110860, WO2011/095819 and WO2006/135881.

The diesel fuel additive mixture may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide, those peroxide compounds disclosed in WO96/03397 and WO99/32584 and those ignition improvers disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; antioxidants (e.g. phenolics such as 2,6-di-tert-butylphenol, or phenylenediamines such as N,N'-di-sec-butyl-p-phenylenediamine); metal deactivators; combustion improvers; static dissipator additives; cold flow improvers; and wax anti-settling agents.

The diesel fuel additive mixture may contain a lubricity enhancer, especially when the diesel fuel composition has a low (e.g. 500 ppmw or less) sulphur content. In the additivated diesel fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "The Lubricity of Diesel Fuels", Wear, I I I (1986) 217-235;
- WO-A-95/33805—cold flow improvers to enhance lubricity of low sulphur fuels;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It may also be preferred for the diesel fuel composition to contain an anti-foaming agent, more preferably in combination with an anti-rust agent and/or a corrosion inhibitor and/or a lubricity enhancing additive.

Unless otherwise stated, the (active matter) concentration of each such optional additive component in the additivated diesel fuel composition is preferably up to 10000 ppmw, more preferably in the range from 0.1 to 1000 ppmw, advantageously from 0.1 to 300 ppmw, such as from 0.1 to 150 ppmw.

The (active matter) concentration of any dehazer in the diesel fuel composition will preferably be in the range from 0.1 to 20 ppmw, more preferably from 1 to 15 ppmw, still more preferably from 1 to 10 ppmw, and especially from 1 to 5 ppmw. The (active matter) concentration of any ignition improver (e.g. 2-EHN) present will preferably be 2600 ppmw or less, more preferably 2000 ppmw or less, even more preferably 300 to 1500 ppmw. The (active matter) concentration of any detergent in the diesel fuel composition will preferably be in the range from 5 to 1500 ppmw, more preferably from 10 to 750 ppmw, most preferably from 20 to 500 ppmw.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives in the diesel fuel composition may be suitably between 0 and 10000 ppmw and preferably below 5000 ppmw.

In the above, amounts (concentrations, % vol, ppmw, % wt) of components are of active matter, i.e. exclusive of volatile solvents/diluent materials.

Process of Preparing the Liquid Fuel Composition

The liquid fuel composition of the present invention can be produced by admixing the essential one or more organic UV filter compounds and the one or more ester co-additive compounds, preferably together with an additive performance package, with a gasoline or diesel base fuel suitable for use in an internal combustion engine.

The use of one or more organic UV filter compounds in gasoline compositions provides benefits in terms of improved power, improved acceleration and increased flame speed of an internal combustion engine being fuelled by the liquid fuel composition containing said organic UV filter compound, relative to the internal combustion engine being fuelled by the liquid base fuel.

The use of one or more organic UV filter compounds in diesel compositions provides benefits in terms of increased cetane number, modified ignition delay and/or modified burn period.

It has been found by the present inventors that the addition of the one or more ester co-additives improves the stability of the additive blends and liquid fuel compositions of the present invention by improving the solubility of the organic UV filter compounds in the additive blend and/or in the liquid fuel composition.

The present invention will be further understood from the following examples. Unless otherwise stated, all amounts and concentrations disclosed in the examples are based on weight of the fully formulated fuel composition.

Examples 1 to 16

To demonstrate the improved stability properties of the compositions of the present invention a number of additive blends were prepared.

The organic UV filter compounds used in the present examples were Ethylhexyl Dimethyl PABA (EHDPABA) (commercially available from DSM under the tradename Escalol 507/Padimate O) and Octocrylene (OC) (commercially available from DSM under the tradename Escalol 567).

The ester co-additive compounds used in the present examples were C12-C15 Alkyl Ethylhexanoate (commercially available from Innospec under the trade name Activemol EH-25), Bis(2-ethylhexyl)maleate (commercially available from Innospec under the trade name Activemol DOM-R), dipropylene glycol dibenzoate (commercially available from Innospec under the tradename Finsolv PG-22) and 2-ethyl-1-hexanol benzoate (commercially available from Innospec under the tradename Finsolve EB).

The solvents used in Examples 9 to 16 were ethylhexanol and Shellsol A150 commercially available from Shell Chemicals.

Additive blends were formed for each of the organic UV filters containing a UV filter compound (EHDPABA or OC), an ester co-additive compound and a performance additive package. For each additive blend, the performance additive package was the same and was a detergent additive package suitable for use in a gasoline fuel composition.

In order to check the stability of the blends at low temperatures the blends were stored for 6 weeks at −20° C. The analysis was a visual check, recording how clear or cloudy the mixture was and any separation or precipitation present over the 6 week test period.

Example 1 to 8

Examples 1 to 8 all contained EHDPABA as the organic UV filter compound. EHDPABA was one of the most stable of all the UV filters tested in the performance additive package. It gave only a slight haze at 50% v/v (50% EHDPABA and 50% performance additive package) at ambient temperature, showing some separation after 4 weeks at −20° C. In the present example, therefore, EHDPABA was blended such that there were equal levels of EHDPABA and performance additive package, or a higher level of EHDPABA (performance additive package:EHDPABA ratios of 1:1 and 3:4). In the blends with higher levels of EHDPABA, a higher amount of co-additive was also used.

All of the blends remained clear and bright for the duration of the 6 week study.

TABLE 1

EHDPABA results after 6 weeks at −20° C.

| Example | Wt % of Performance Additive Package | Wt % of EHDPABA | Wt % of Activemol EH-25 | Wt % of Activemol DOM-R | Finsolv PG-22 | Finsolve EB | Appearance after 6 weeks at −20° C. |
|---|---|---|---|---|---|---|---|
| 1 | 40 | 40 | 20 | — | — | — | clear |
| 2 | 40 | 40 | — | 20 | — | — | clear |
| 3 | 40 | 40 | — | — | 20 | — | clear |
| 4 | 40 | 40 | — | — | — | 20 | clear |
| 5 | 30 | 40 | 30 | — | — | — | clear |
| 6 | 30 | 40 | — | 30 | — | — | clear |
| 7 | 30 | 40 | — | — | 30 | — | clear |
| 8 | 30 | 40 | — | — | — | 30 | clear |

Examples 9 to 16

Examples 9 to 16 all contained Octocrylene (OC) as the organic UV filter compound. OC was soluble in the performance additive package at 10% and 20% treat rate (additive package:OC ratios of 9:1 and 4:1), giving a slightly hazy yellow solution. Both remained stable at ambient temperature, however at −20° C. they each showed separation after 5 days.

For examples 9 to 16, performance additive package:OC ratios of 2:1 or 11:6 were chosen, with the 11:6 blends having a higher level of ester co-additive compound in the blend and all blends having a small amount of additional solvent.

All of the blends remained clear and bright at −20° C. for the duration of the 6 week study.

TABLE 2

| OC results after 6 weeks at −20° C. | | | | | | | | | |
|---|---|---|---|---|---|---|---|---|---|
| Eg. | Wt % additive package | Wt % OC | Wt % Activemol EH-25 | Wt % Activemol DOM-R | Wt % Finsolv PG-22 | WT % Finsolve EB | Wt % 2-ethylhexanol | Wt % Shellsol A150 | Appearance after 6 weeks at −20° C. |
| 9 | 48 | 24 | 20 | — | — | — | 4 | 4 | Clear |
| 10 | 48 | 24 | — | 20 | — | — | 4 | 4 | Clear |
| 11 | 48 | 24 | — | — | 20 | — | 4 | 4 | Clear |
| 12 | 48 | 24 | — | — | — | 20 | 4 | 4 | Clear |
| 13 | 44 | 24 | 24 | — | — | — | 4 | 4 | Clear |
| 14 | 44 | 24 | — | 24 | — | — | 4 | 4 | Clear |
| 15 | 44 | 24 | — | — | 24 | — | 4 | 4 | Clear |
| 16 | 44 | 24 | — | — | — | 24 | 4 | 4 | clear |

CONCLUSIONS

Examples 1-16 demonstrate that the addition of ester co-additives can provide improvements in stability properties in additive blends containing one or more organic UV filter compounds, especially at low temperatures such as −20° C.

The invention claimed is:

1. A liquid fuel composition comprising:

(a) a base fuel suitable for use in an internal combustion engine;

(b) in the range of from 10 ppmw to 2 wt %, by weight of the liquid fuel composition, of one or more organic UV filter compounds; and (c) in the range of from 0.001 wt % to 0.5 wt %, by weight of the liquid fuel composition, of one or more ester co-additive compounds selected from esters of monoalcohols and monocarboxylic acids prepared by the reaction of a $C_4$-$C_{18}$ branched or straight-chain monocarboxylic acid with a $C_4$-$C_{18}$ branched or straight chain monoalcohol, and esters of monoalcohols and dicarboxylic acids prepared by the reaction of a $C_4$-$C_{12}$ branched or straight chain dicarboxylic acid with a $C_3$-$C_{18}$ branched or straight chain monoalcohol.

2. The liquid fuel composition of claim 1, wherein the $C_4$-$C_{18}$ branched or straight chain monocarboxylic acid is 2-ethyl hexanoic acid and wherein the $C_4$-$C_{12}$ branched or straight chain dicarboxylic acid is maleic acid.

3. The liquid fuel composition of claim 1, wherein the one or more organic UV filter compounds is selected from (i) alkyl β,β-diphenylacrylate and/or alpha-cyano-beta,beta-diphenylacrylate derivatives; (ii) salicylic derivatives; (iii) cinnamic derivatives; (iv) dibenzoylmethane derivatives; (v) camphor derivatives; (vi) benzophenone derivatives; (vii) p-aminobenzoic acid derivatives; (viii) phenalkyl benzoate derivatives; and (ix) nitrogen-containing heterocyclic derivatives selected from imidazoles, triazines, triazones and triazoles; and mixtures thereof.

4. The liquid fuel composition of claim 1, wherein the weight ratio of the one or more organic UV filter compounds to the one or more ester co-additive compounds is in the range from 90:10 to 10:90.

5. The liquid fuel composition of claim 1, wherein the base fuel is selected from a gasoline base fuel or a diesel base fuel.

6. The liquid fuel composition of claim 5, further comprising an additive package.

7. The liquid fuel composition of claim 5, further comprising one or more detergents.

8. The liquid fuel composition of claim 7, additionally comprising one or more additive compounds selected from cetane improvers, corrosion inhibitors, and mixtures thereof.

9. An additive blend suitable for use in a liquid fuel composition wherein the additive blend comprises (i) one or more organic UV filter compounds; (ii) one or more ester co-additive compounds selected from esters of monoalcohols and monocarboxylic acids prepared by the reaction of a $C_4$-$C_{18}$ branched or straight-chain monocarboxylic acid with a $C_4$-$C_{18}$ branched or straight chain monoalcohol, and esters of monoalcohols and dicarboxylic acids prepared by the reaction of a $C_4$-$C_{12}$ branched or straight chain dicarboxylic acid with a $C_3$-$C_{18}$ branched or straight chain monoalcohol, and mixtures thereof; and one or more detergents.

10. The additive blend of claim 9, additionally comprising one or more additive compounds selected from cetane improvers, corrosion inhibitors, and mixtures thereof.

11. The additive blend of claim 9, additionally comprising one or more solvents.

12. A liquid fuel composition comprising:

(a) a base fuel suitable for use in an internal combustion engine;

(b) an additive blend according to claim 9.

13. A method of increasing the solubility of one or more organic UV filter compounds in a liquid fuel composition, comprising:

providing a liquid fuel composition comprising:

(a) a base fuel suitable for use in an internal combustion engine;

(b) one or more organic UV filter compounds in the range of from 10 ppmw to 2 wt %, by weight of the liquid fuel composition; and (c) in the range of from 0.001 wt % to 0.5 wt %, by weight of the liquid fuel composition, of one or more ester co-additive compounds selected from esters of monoalcohols and monocarboxylic acids prepared by the reaction of a $C_4$-$C_{18}$ branched or straight-chain monocarboxylic acid with a $C_4$-$C_{18}$ branched or straight chain monoalcohol, and esters of monoalcohols and dicarboxylic acids prepared by the reaction of a $C_4$-$C_{12}$ branched or straight chain dicarboxylic acid with a $C_3$-$C_{18}$ branched or straight chain monoalcohol.

* * * * *